United States Patent [19]

Marek et al.

[11] 4,012,707

[45] Mar. 15, 1977

[54] FUSIBLE ELEMENT FOR ELECTRICAL APPARATUS

[75] Inventors: James R. Marek; Michael J. Zunick, both of South Milwaukee, Wis.

[73] Assignee: McGraw-Edison Company, Elgin, Ill.

[22] Filed: Aug. 27, 1975

[21] Appl. No.: 608,037

[52] U.S. Cl. ..... 337/27; 337/162; 337/166

[51] Int. Cl.[2] ..... H01H 61/00

[58] Field of Search ..... 335/159, 161, 162, 164, 335/166, 17, 28, 290, 292, 295, 296

[56] References Cited

UNITED STATES PATENTS

| | | | |
|---|---|---|---|
| 1,446,554 | 2/1923 | Ellison | 337/292 |
| 2,816,989 | 12/1957 | Sugden | 337/292 |
| 3,244,839 | 4/1966 | Albright | 337/159 |
| 3,806,680 | 4/1974 | Link | 337/166 X |
| 3,913,047 | 10/1975 | Arthur et al. | 337/17 |

*Primary Examiner*—George Harris
*Attorney, Agent, or Firm*—Jon Carl Gealow

[57] ABSTRACT

Multiple portions exhibiting relatively different heat conductance characteristics, and so arranged that heat is concentrated in the fusible element, are used to control the heat transfer in a fusible element to achieve preselected time-current fusion characteristics. A portion of the fusible element may also be made of a material exhibiting a relatively high temperature coefficient of resistance for additional control definition of the time-current characteristics.

10 Claims, 6 Drawing Figures

FUSIBLE ELEMENT FOR ELECTRICAL APPARATUS

BACKGROUND OF THE INVENTION

This invention relates to fusible elements for electrical apparatus such as vacuum fuses or interrupters.

Such apparatus can be subjected, among other conditions, to relatively high fault currents, which can be referred to as a short time high current condition, and to a prolonged overload current, which can be referred to as a long time low current condition. As can be verified on time-current curves, the cross sectional area of the fusible element is a major factor in determining the short time high current fusion condition and the length of the element is a major factor in determining the long time low current fusion condition.

In electrical apparatus such as vacuum fuses and/or interrupters there is an optimum spacing between electrodes which should not be exceeded and it is generally quite short. This does not afford much latitude for controlling time-current fusion characteristics by varying element length. Moreover, the nature of the materials generally required in such apparatus is such that they are good heat conductors. Therefore, any length variations that may be required would be difficult to accomplish in the available space.

Among the general objects of this invention is to control the heat to which the fusible element is subjected and, more specifically, to control the flow of heat from the fusible element.

SUMMARY OF THE INVENTION

For the achievement of these and other objects, this invention proposes to control the time-current characteristics of a vacuum fuse, interrupter, or the like by controlling the heat to which the fusible element threof is exposed.

Preferably, materials having different heat conductance characteristics are used in the fusible element to control the flow of heat from the fusible element. This will afford control over the long time current fusion characteristic, and in a manner which is not limited by the space available to vary the length of the fusible element.

It is also preferred, in some embodiments, to use a portion of material in the fusible element which exhibits a relatively high temperature coefficient of resistance. This permits more precise control of both short time high and long time low current fusion characteristics.

Other objects and advantages will be pointed out in, or be apparent from, the specification and claims, as will obvious modifications of the embodiments shown in the drawings, in which:

DESCRIPTION OF THE PREFERRED EMBODIMENTS

Figure 1:
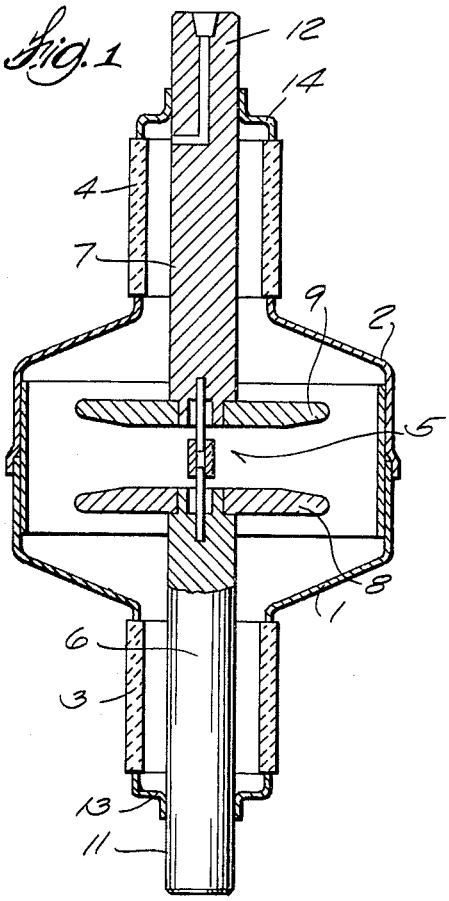
FIG. 1 is a general showing of a vacuum fuse embodying this invention.

FIG. 1 illustrates a vacuum fuse comprising an outer housing made up to two bell-shaped metallic sections 1 and 2 and ceramic insulators 3 and 4. Rods 6 and 7 support spaced electrodes 8 and 9 within the housing and extend exteriorly of the housing to provide contact portions 11 and 12 through which the actual electrial circuit connection of the fuse is made. Caps 13 and 14 complete the outer housing, extending between the ceramic insulators and the electrode support rods. Fusible element 5 bridges the gap between electrodes 8 and 9. All joints in the outer housing are sealed so as to be airtight and the interior is evacuated so that fusion of element 5 will occur, when the fuse is called upon to operate in a vacuum environment. This invention is directed to the fusible element and the construction of the remainder of the vacuum fuse is conventional so that this general description of the fuse should be sufficient for an understanding of this invention.

Several arrangements of fusible elements and electrode support members illustrated in FIGS. 2–6 are as used in electrical apparatus such as vacuum fuses or vacuum interrupters. The invention, although discussed as embodied in a vacuum fuse, should not be interpreted as being so limited.

As is general practice, electrodes 8 and 9 are spaced and define a gap which is bridged by fusible element 5 which, in turn, is formed by end portions 16 and 17 and a midportion 18. End portions 16 and 17 fit into bores 19 and 21 in the free ends of rods 6 and 7 and project toward each other but terminate in spaced relationship. The spacing between portions 16 and 17 is bridged by generally cylindrical midportion 18.

As discussed above, one of the objectives of this invention is to control the flow of heat away from the fusible element so as to afford control over the long time low current fusion characteristics. To this end, portions 16 and 17 are made of the same material or materials which exhibit similar heat conductance characteristics whereas midportion 18 is made of a different material or a material exhibiting relatively higher heat conductance characteristics than that of portions 16 and 17. With that arrangement, the flow of heat from the midportion 18 to the support rods 6 and 7 is impeded by the lesser heat conductance capability of portions 16 and 17. This tends to retain self-generated heat in midportion 18 and that portion will fuse sooner than would be the case if the entire fusible element bridging electrodes 8 and 9 was made of portions of the same material or having the same heat conducting capability. For example, end portions 16 and 17 can be made of iron and midportion 18 of copper.

With reference to a well known time-current curve, the high fault current characteristic, or short time high current fusion condition, can be controlled by regulating the effective cross sectional area of the fusible element. Whereas, in the past, the prolonged overload current characteristics, or long time low current condition, has generally been a factor of fusible element length, with this invention that condition can be controlled by attention to the relative heat conductance properties of portions 16, 17, and 18 of the fusible element. This affords relatively wide latitude of design freedom for the fusible element.

Figure 2:
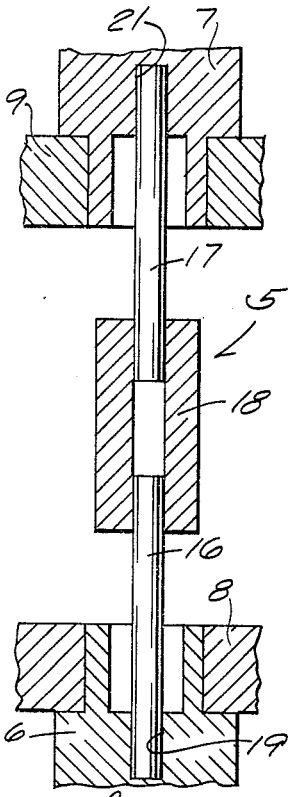
FIG. 2 is an enlarged showing of the fusible element area of the vacuum fuse of FIG. 1.
Figure 3:
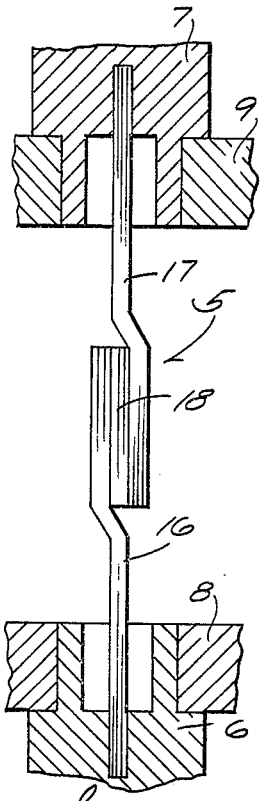
FIGS. 3–6 illustrate several alternative embodiments of the invention.
Figure 4:
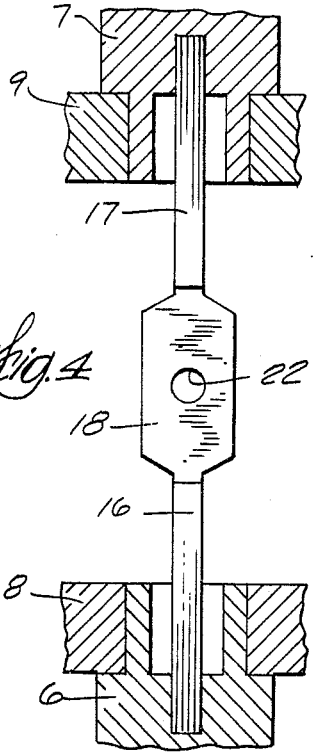

FIGS. 3 and 4 relate to an arrangement of the fusible element portions which is similar operationally to that of FIGS. 1 and 2 but is slightly different structurally. For ease of description, the same numbers have been applied to the corresponding members of FIGS. 2, 3 and 4.

In FIG. 3, end portions 16 and 17 overlap in the gap between electrodes 8 and 9. The end portions are offset and midportion 18 is positioned in the area defined by the overlapping, offset ends.

In FIG. 4, end portions 16 and 17 are spaced from each other but are joined by a midportion 18 which has been flattened and provided with a central aperture 22. The aperture is a conventional means of insuring initiation of fusion in the center of the element.

As in FIGS. 1 and 2, end portions 16 and 17 of FIGS. 3 and 4 can be made of iron and midportion 18 of copper. The portions are suitably joined in a conventional manner.

These arrangements concentrate the generated heat in the midportions 18 of the fusible elements. This has the added advantage of contributing to the insurance of initiation of fusion, and any arc which is drawn in the center of the element.

The embodiments discussed to this point all have the material of lower heat conductance physically and thermally isolating the material of higher heat conductance from the electrodes 8 and 9. More specifically, the examples of iron and copper have the iron connected to the electrodes and the copper spaced from the electrodes by the iron portions. The arrangement of materials can be reversed and satisfactory results still obtained since, in the example of copper and iron, the iron will exhibit a higher electrical resistance than the copper and will generate more heat which will tend to be concentrated in the midsection. It should also be appreciated that this is not necessarily true only for copper and iron as other materials which exhibit different heat conductant properties and different electrical resistances can be used. It has also been recognized that if a material having a relatively high temperature coefficient of resistance is used for the central portion 18 of the fusible element, further control over the fusion characteristics can be achieved. More specifically, both the short time high current and long time low current characteristics can be controlled to some measure by attention to the relative temperature coefficient of the materials. For example, Chromel "D" and Konel (both chrome-nickel-steel alloys) exhibit desirable temperature coefficients of resistance, both of which are greater than copper and will provide adequate control. Both Chromel "D" and Konel are commercially available alloy materials.

By using materials having the relatively high temperature coefficient of resistance along with other materials such as copper, precise control over both the short time high current fusion characteristics and the long time low current fusion characteristics are achieved. It being remembered that the energy to melt the fusible element is proportional to $I^2R$ so that if R can be made to increase with temperature and at different rates by use of different materials, control over the amount of energy necessary to melt the element, and thus melting, is achieved.

This reversal of the elements still operates within the basic parameters of the invention. Even though the end portions may have a lower heat conducting property than the center section, the higher resistance or higher temperature coefficient of resistance material will be generating heat faster than it can be conducted away by the end portions. Thus, heat flow is controlled and the temperature of the center section increases as desired.

Figure 5:
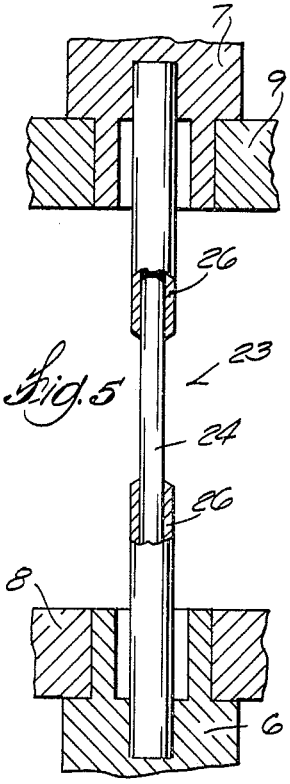

FIG. 5 illustrates a somewhat modified variation of the arrangements of FIGS. 1–4. In FIG. 5, the electrodes are bridged by a composite fusible element 23. Fusible element 23 includes a core 24, which can be made of iron, and has a layer 26 fused over the core. The outer fused layer can be made of copper. The central section of fusible element 23 is machined to remove the outer copper layer. Due to the difference in heat conductance characteristics and resistance, the self-generated heat will again be concentrated in the machined central area with the same results as discussed above.

The multi-layer fusible element 23 of FIG. 5 can be either circular or rectangular in cross section. In the former case, the central core of iron is surrounded by an annular, in cross section, copper layer, in the latter instance a central strip of iron is sandwiched between two strips of copper.

Figure 6:
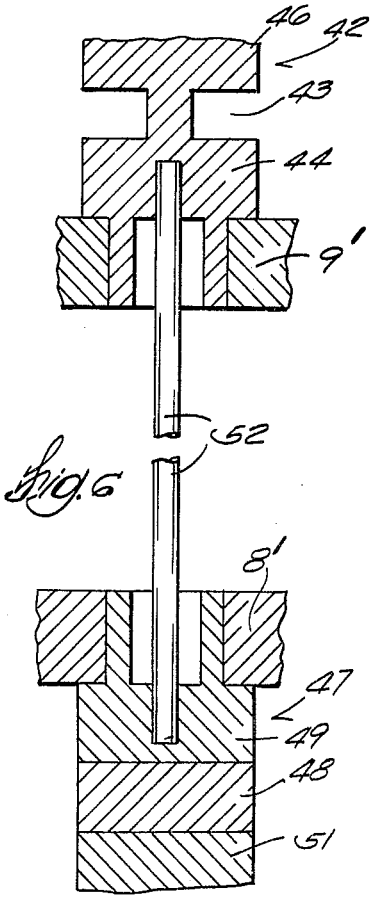

FIG. 6 illustrates an arrangement which incorporates features of both the mechanical configuration and a difference in heat conductance materials to control heat flow from the center of the element. More specifically, electrode support 42 is provided with an undercut portion 43. This interrupts the direct heat flow passage from the outer end 44 of support 42 to the inner portion 46 thereof. Electrode support 47 has a portion 48 of material having a different heat conductance characteristic than the material of the remainder of the support inserted adjacent its end 49 but spaced inwardly from that end. Portion 48 is connected between outer end 49 and the inner portion 51 of the contact support. Fusible element 52 bridges the gap between electrodes 8' and 9' and is of the same material as the basic electrode support members 42, 44 and 49, 51. Insert 48 has a lower heat conductance than that basic material. Therefore, heat flow from fusible element 52 is impeded by undercut 43 and portion 48 and the self-generated heat is concentrated in the fusible element. The undercut may be provided at both ends of the fusible element, i.e. in both 42 and 47.

Although this invention has been illustrated and described in connection with particular embodiments thereof, it will be apparent to those skilled in the art that various changes and modifications may be made therein without departing from the spirit of the invention or from the scope of the appended claims.

We claim:

1. In an electrical interrupter having spaced electrodes supported by support rods and a fusible element bridging said spaced electrodes, and wherein said fusible element is subjected to elevated temperatures as a result of overload current conditions and fuses to open the circuit between said electrodes, the improvement of means in the area of said fusible element for controlling the transfer of heat between said fusible element and said support rods, said means concentrating the heat generated by current in said fusible element to a defined portion of said fusible element and operative to attribute preselected time-current fusion characteristics to said electrical interrupter.

2. The electrical interrupter of claim 1 wherein said means is a part of said support rods.

3. The electrical interrupter of claim 1 wherein fusible element includes a central section and end portions and said central section has a higher temperature coefficient of resistance relative to said end portions.

4. The electrical interrupter of claim 1 wherein said fusible element includes a midportion and end portions connecting said midportion to said support rods, and the midportion being made of a metal dissimilar to that of said end portions and exhibiting heat conductance characteristics which are relatively greater than the heat conductance characteristics of said end portions so that heat is concentrated in said midportion.

5. The electrical interrupter of claim 4 wherein said midportion is made of copper and said end portions are made of iron.

6. The electrical interrupter of claim 1 wherein said fusible element comprises a laminated member having first and second portions of different heat conductance characteristics, one of said portions being continuous between said electrodes and the other being interrupted.

7. The electrical interrupter of claim 1 wherein said means is provided by a section of at least one of said support rods having a configuration and effective cross sectional area different from that of the remainder of said support rod.

8. The electrical interrupter of claim 7 wherein said section has a reduced cross sectional area relative to the remainder thereof.

9. In an electrical interrupter the combination comprising, first and second electrodes spaced from each other and supported by support rods, a fusible element connected to said support rods and bridging the space between said electrodes, said fusible element having a midportion made of a metal having preselected heat conductance characteristics and end portions engaging each of electrodes, and said end portions having heat conductance characteristics less than the heat conductance characteristics of said midportion so that heat is concentrated in said midportion and the relationship of said characteristics attribute preselected time-current fusion characteristics to said electrical interrupter.

10. In an electrical interrupter having spaced electrodes supported by support rods and a fusible element bridging said spaced electrodes, and wherein said fusible element is subjected to elevated temperatures as a result of overload current conditions and fuses to open the circuit between said electrodes, the improvement of means which is a part of said support rods, for controlling the transfer of heat between said fusible element and said support rods, one of said support rods includes an undercut portion adjacent to but spaced from the end thereof defining a portion of reduced cross sectional area adjacent said end, and the other one of said support rods includes, as a part thereof, a portion adjacent to but spaced from the end thereof and having heat conductance characteristics different from said fusible element, said means concentrating the heat generated by current in said fusible element to a defined portion of said fusible element and operative to attribute preselected time-current fusion characteristics to said electrical interrupter.

* * * * *